US006511316B2

(12) United States Patent
Harada et al.

(10) Patent No.: US 6,511,316 B2
(45) Date of Patent: Jan. 28, 2003

(54) METHOD OF OPERATING A ROTARY HEARTH FURNACE

(75) Inventors: Takao Harada, Osaka (JP); Masahiko Tetsumoto, Osaka (JP); Hidetoshi Tanaka, Osaka (JP)

(73) Assignee: Kabushiki Kaisha Kobe Seiko Sho, Kobe (JP)

( * ) Notice: Subject to any disclaimer, the term of this patent is extended or adjusted under 35 U.S.C. 154(b) by 0 days.

(21) Appl. No.: 09/892,695

(22) Filed: Jun. 28, 2001

(65) Prior Publication Data

US 2002/0076670 A1 Jun. 20, 2002

(30) Foreign Application Priority Data

Jun. 29, 2000 (JP) ..... 2000-195998

(51) Int. Cl.[7] ..... F27B 9/16

(52) U.S. Cl. ..... 432/138; 432/139; 266/177; 75/484

(58) Field of Search ..... 432/124, 138, 432/139, 195; 266/177; 75/484

(56) References Cited

U.S. PATENT DOCUMENTS

| | | | | |
|---|---|---|---|---|
| 3,443,931 A | | 5/1969 | Beggs et al. | |
| 3,507,408 A | | 4/1970 | Bramwell | |
| 3,667,743 A | | 6/1972 | Kovalcik et al. | |
| 4,636,127 A | | 1/1987 | Olano et al. | |
| 5,885,521 A | | 3/1999 | Meissner et al. | |
| 5,924,861 A | | 7/1999 | Rinker et al. | |
| 5,989,019 A | | 11/1999 | Nishimura et al. | |
| 6,015,527 A | | 1/2000 | Kamei et al. | |
| 6,063,156 A | | 5/2000 | Negami et al. | |
| 6,117,387 A | * | 9/2000 | Sarma et al. | 266/177 |
| 6,129,777 A | | 10/2000 | Fuji et al. | |
| 6,149,709 A | | 11/2000 | Uragami et al. | |
| 6,152,983 A | | 11/2000 | Kamijo et al. | |
| 6,224,820 B1 | * | 5/2001 | Sawa et al. | 266/178 |
| 6,241,803 B1 | | 6/2001 | Fuji | |
| 6,251,161 B1 | | 6/2001 | Tateishi et al. | |
| 6,254,665 B1 | | 7/2001 | Matsushita et al. | |
| 6,258,149 B1 | | 7/2001 | Sugiyama et al. | |

FOREIGN PATENT DOCUMENTS

| | | |
|---|---|---|
| WO | WO 99/00633 | 1/1999 |
| WO | WO 00/29628 | 5/2000 |

OTHER PUBLICATIONS

Patent Abstract of Japan, JP 62–136518, Jun. 19, 1987.

* cited by examiner

*Primary Examiner*—Gregory Wilson
(74) *Attorney, Agent, or Firm*—Oblon, Spivak, McClelland, Maier & Neustadt, P.C.

(57) ABSTRACT

To provide an operating method of a rotary hearth furnace for producing reduced iron in which a stuck substance stuck on the hearth surface is removed from the hearth surface to thereby prevent or reduce the wear of the knife edge of a screw of a discharge device, enabling continuous operation for a long period and capable of achieving high availability factor. The hearth surface is quenched by spraying or the like to generate cracks in the stuck substance on the hearth, and the stuck substance is scraped to thereby remove it from the hearth.

17 Claims, 3 Drawing Sheets

METHOD OF OPERATING A ROTARY HEARTH FURNACE

BACKGROUND OF THE INVENTION

1. Field of the Invention

The present invention relates to a method for maintaining, when reduced metal is produced from metal oxide using a rotary hearth furnace, the hearth surface clean by removing stuck substances stuck on the hearth to prevent reduced metal discharge means (device) from being worn.

2. Description of the Related Art

With recent trend of activation of producing steel by an electric furnace, a demand for reduced iron is now increasing due to pressure for supply and demand of scraps as main raw material thereof or a demand for production of high-class steel by an electric furnace.

As one of processes of producing reduced iron, attention has been paid to a process of mixing powdery iron ore and carbon material such as powdery coal or coke to form lump-like substances, for example, pellets, charging the pellets into a rotary hearth furnace, heating it at a high temperature to thereby reduce oxide iron in the iron ore to obtain solid metal.

One example of a reduced iron producing process by a conventional rotary hearth furnace will be explained with reference to a plan view explaining a schematic constitution of equipment of the rotary hearth furnace used in the past shown in FIG. 4.

Powdery iron oxide and powdery carbonaceous material are mixed and granulated to produce raw pellets. and granulated to produce raw pellets.

The raw pellets are heated to a temperature level to a degree that inflammable volatile substance generated from pellets is not fired to remove stuck moisture to form dry pellets (raw material 9).

The dry pellets (raw material 9) are supplied into a rotary hearth furnace 7 using a suitable charging device 3 to form a pellet layer on the rotary hearth 1.

The pellet layer is radiation heated by combustion by burners 7*c* installed at the upper part within the furnace to reduce it, which is metallized to obtain reduced iron.

The reduced iron is cooled by directly spraying gas on the reduced iron using a cooler 8 or cooled indirectly by a water cooling jacket to discharge it outside.

In the reduced iron producing process by the rotary hearth furnace, when the lump-like substance is placed on the rotary hearth furnace, the lump-like substance is powdered to generate powder due to the mechanical shock or the like. Further, even after being placed, the substance is exposed to a high temperature atmosphere within the furnace, CO or $CO_2$ gases are generated by de-volatilizing of volatile components in carbon or reducing reaction to increase internal pressure of lump-like substance so that the lump-like substance is broken, or explosion occurs to generate powder. The thus generated powder is reduced within the rotary hearth furnace to form powder of oxide iron.

Further, the discharge of the lump-like substance (reduced iron) which is reduced within the rotary hearth furnace and metallized is normally carried out using a screw type discharge device, but also in this case, reduced iron receives mechanical handling to generate powder.

The thus generated powder is difficult to be removed completely by the discharge device, a part of which remains on the hearth or is rubbed into the hearth surface by the discharge device. When powder is stayed in the furnace, the powder are sintered together at high temperature and stuck on the hearth, and new powder is accumulated on the stuck substance and grows. Powder contains not only metal iron but also ore components (slag components) derived from gangue in iron oxide or ash in carbonaceous substance, and the ore components (slag components) are repetitively molten and coagulated on the hearth. Further, the slag components are compressed and rolled together with metal iron by the discharge device whereby the metal iron and the slag components are mixed to create a texture having high hardness.

The discharge device is cooled by a suitable method in order to secure its mechanical strength, but since the stuck substance on the hearth is hard and at high temperature, the knife edge of the discharge device rises in temperature and becomes worn due to friction heat generated when in contact with the stuck substance. Therefore, the operation is often interrupted and work for replacing a screw of the discharge device is necessary, posing a serious problem of lowering of availability factor and higher maintenance costs.

In order to cope with the above problem, various proposals have been made to scheme a cooling method (construction) of a screw blade of the discharge device so as to reduce wear of the knife edge.

For example, one method is that a blade is made to be hollow, into which cooling water flows to thereby cool the blade, thus reducing a damage resulting from corrosion of the blade.

A further method is that a cooling pipe is arranged so as to surround the discharge device, the blade is cooled by radiation cooling thereof to reduce a damage resulting from corrosion of the blade or wear of the knife edge.

However, even if the blade is water-cooled, a temperature of the knife edge in contact with the hearth which is high in temperature and is high in hardness rises to provide less effect in reducing the wear of the knife edge. Moreover, when the wear of the knife edge progresses and cooling water leaks, the product, reduced iron becomes oxidized again.

Further, since the indirect cooling method by way of radiation cooling by a water cooling pipe is used, there is no problem of a leakage of cooling water caused by the wear of die knife edge as described above, but because of the indirect cooling, the effect of cooling the knife edge is smaller than that of the above-described invention failing to rarely provide effect for the wear of the knife edge.

In view of the foregoing, development of a method capable of easily removing the stuck substance even if the stuck substance is formed on the hearth has been demanded in order to solve the aforementioned problem basically. For example, the following proposal has been made, which is however not enough to solve the problem.

There are proposed a method of, in order to remove powder of metal iron or stuck substances staying on the hearth, blowing it off with jet gas to recover it by a suction hood, and a method of scraping it by a scraper. However, the method of blowing off by a flow of jet gas has a problem that removal of the stuck substance stuck on the hearth strongly is difficult, and powder of metal iron blown off becomes adhered within the suction hood. Further, in the method of sweeping out by a broom with a rotary blade, removal of the stuck substance stuck on the hearth strongly is likewise difficult. Furthermore, the method of scraping by a scraper has a problem that as described above, powder of metal iron is struck by the scraper and compressed and rolled, resulting in higher possibility of accelerating the growth of the stuck substances.

It is therefore an object of the present invention to provide an operating method of a rotary hearth type reducing furnace for positively removing stuck substances stuck on the hearth by a simple method to thereby prevent or reduce wear of a knife edge of a screw of a discharge device to enable continuous operation for a long period and to enable achievement of high availability factor.

SUMMARY OF THE INVENTION

An operating method of a rotary hearth type reducing furnace, an operating method of a rotary hearth type reducing furnace for producing reduced metal from raw material comprising at least metal oxide and carbonaceous material, the method including the steps of quenching a hearth surface of said rotary hearth type reducing furnace, and removing a stuck substance from said hearth.

An operating method of a rotary hearth type reducing furnace, an operating method of a rotary hearth type reducing furnace for producing reduced metal from raw material comprising at least metal oxide and carbonaceous material, the method including the steps of applying mechanical shock to a hearth surface, and removing a stuck substance from said hearth.

An operating method of a rotary hearth type reducing furnace, an operating method of a rotary hearth type reducing furnace for heating and reducing raw material comprising at least metal oxide and carbonaceous material to produce reduced metal, the method including the steps of quenching a hearth surface of said rotary hearth type reducing furnace, applying mechanical shock to the hearth surface, and removing a stuck substance from said hearth.

The operating method of a rotary hearth type reducing furnace, wherein said quenching is a directly quenching with water.

The operating method of a rotary hearth type reducing furnace, wherein a quantity of said water is changed to thereby adjust a thickness of the stuck substance removed.

The operating method of a rotary hearth type reducing furnace, wherein stuck substance breaking means installed on a ceiling part above said hearth surface is dropped on said hearth surface to thereby apply mechanical shock.

The operating method of a rotary hearth type reducing furnace, wherein stuck substance breaking means installed on a ceiling part above said hearth surface is driven up and down to thereby apply mechanical shock.

The operating method of a rotary hearth type reducing furnace, wherein after said quenching and or after application of said mechanical shock, said hearth surface is heated again before said stuck substance is removed from said hearth.

The operating method of a rotary hearth type reducing furnace, wherein said quenching position and or position applying said mechanical shock are or is the hearth surface between a position for discharging said reduced metal from said rotary hearth type reducing furnace and a position for charging said raw material into said rotary hearth furnace.

An operating method of a rotary hearth type reducing furnace for heating and reducing raw material comprising at least powdery metal oxide and powdery carbonaceous material to produce reduced metal, wherein a hearth surface of said rotary hearth type reducing furnace is quenched to generate crack in a stuck substance stuck on said hearth, after which said stuck substance is removed from said hearth.

An operating method of a rotary hearth type reducing furnace for heating and reducing raw material comprising at least powdery metal oxide and powdery carbonaceous material to produce reduced metal, wherein mechanical shock is applied to a hearth surface of said rotary hearth type reducing furnace to generate crack in a stuck substance stuck on said hearth, after which said stuck substance is removed from said hearth.

An operating method of a rotary hearth type reducing furnace for heating and reducing raw material comprising at least powdery metal oxide and powdery carbonaceous material to produce reduced metal, wherein a hearth surface of said rotary hearth type reducing furnace is quenched to generate crack in a stuck substance stuck on said hearth, and mechanical shock is applied to said hearth furnace, after which said stuck substance is removed from said hearth.

DESCRIPTION OF THE PREFERRED EMBODIMENTS

Figure 1:
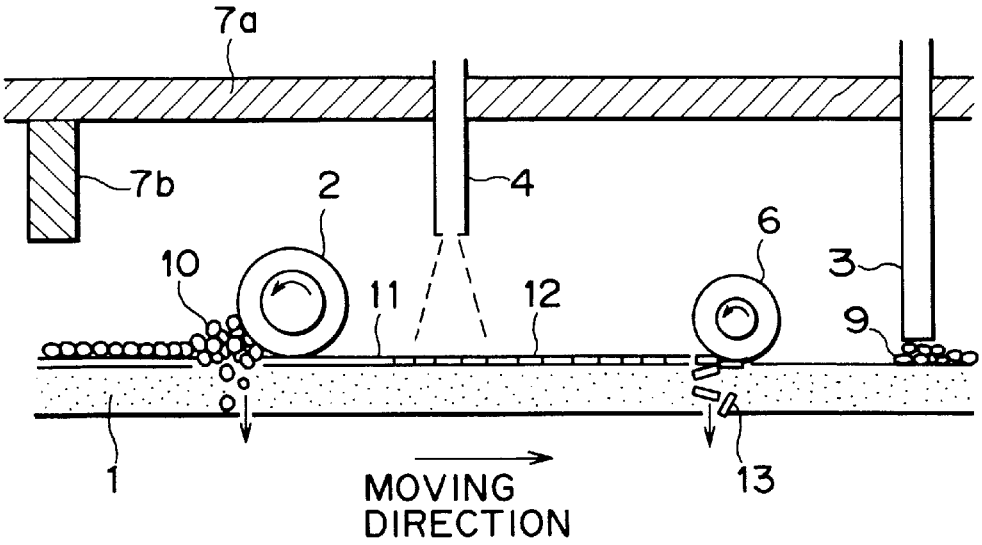
FIG. 1 is an explanatory view showing one embodiment (spraying means+stuck substance scraping means)
Figure 2:
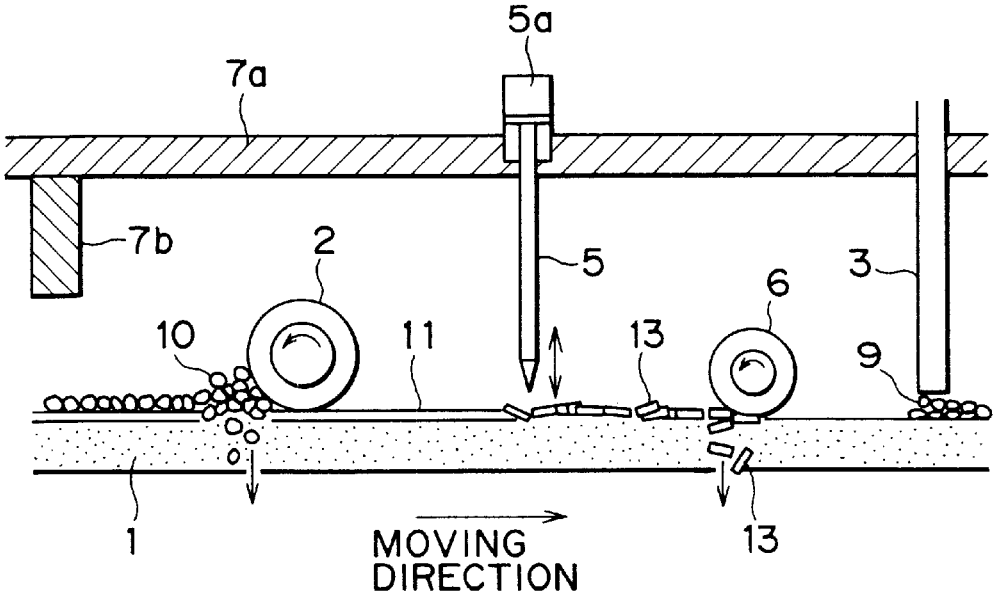
FIG. 2 is an explanatory view showing one embodiment (stuck substance breaking means+stuck substance scraping means)
Figure 3A:
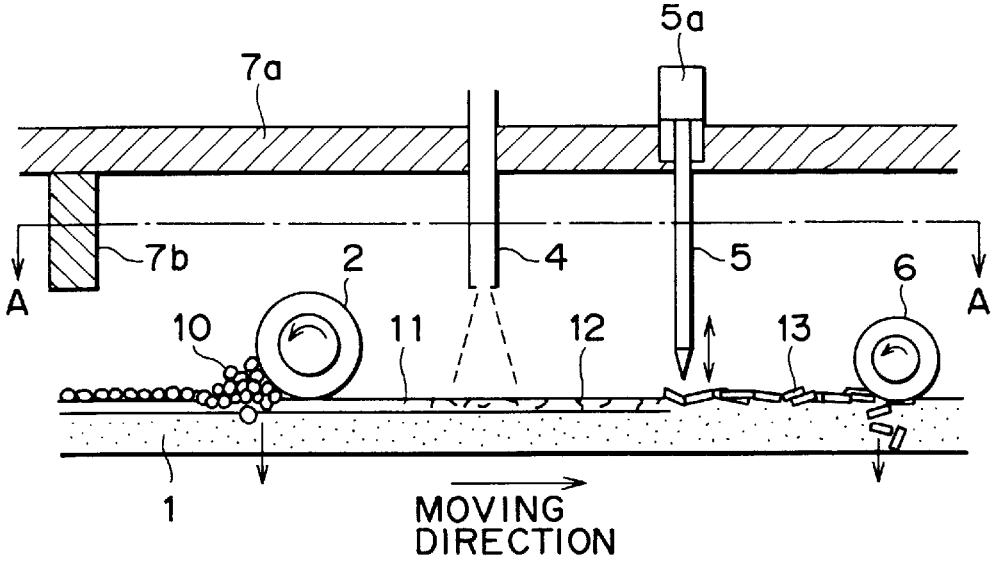
FIG. 3 is an explanatory view showing one embodiment (spraying means+stuck substance breaking means+stuck substance scraping means), (a) being a sectional view, (b) being a plan view taken at AA surface.
Figure 3B:
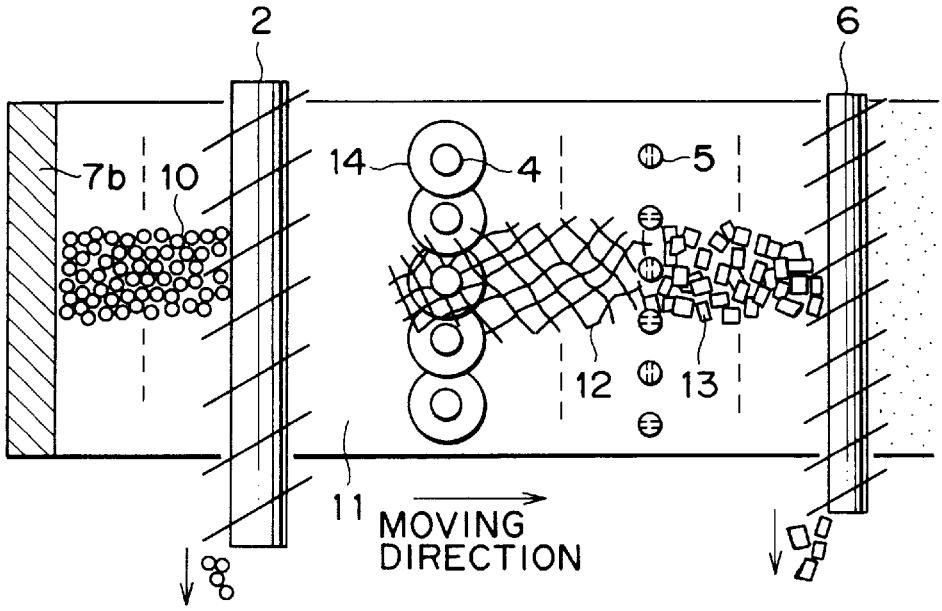
Figure 4:
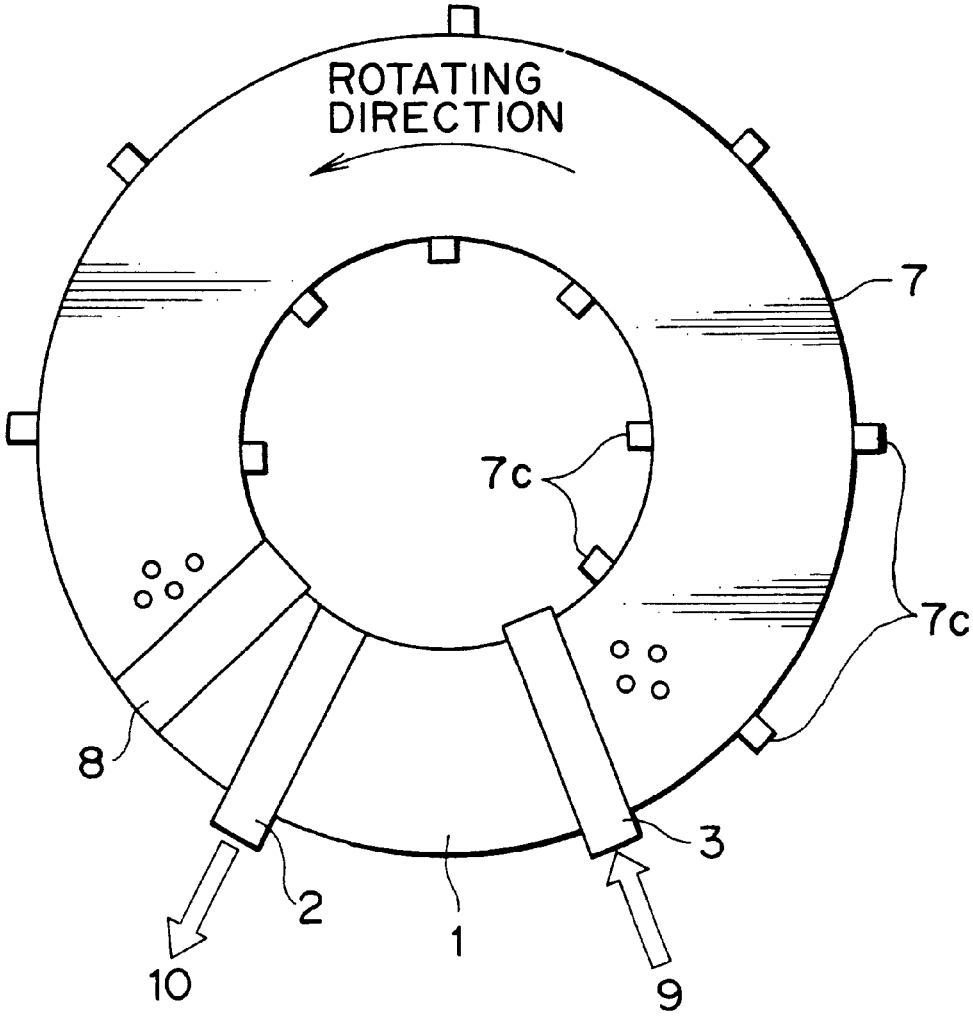
FIG. 4 is a plan view showing a schematic constitution of equipment of a rotary hearth type maintenance used heretofore.

The embodiments of the present invention will be described in detail hereinafter with reference to explanatory views showing the embodiments of the present invention shown in FIGS. 1 to 3, and a plan view explaining a schematic constitution of equipment heretofore used shown in FIG. 4. The embodiments of the present invention explained in connection with FIGS. 1 to 3 are of an example for producing reduced iron.

First, lump-like material (raw material) 9 comprising powdery iron oxide and powdery carbonaceous material is placed on a hearth 1 by a charging device 3 such as a pipe.

Hereupon, as raw material, powdery iron oxide, there can be used powdery iron ore, or dust, sludge, scale or the like containing iron generated in an iron works or an electric furnace factory, singly or in combination of not less than two kinds, similarly to the conventional method.

As powdery carbonaceous material, there can be used coal, coke powder, petroleum coke, char, charcoal, etc., singly or in combination of not less than two kinds, similarly to the conventional method.

During the lump-like substance (raw material) 9 moves within the furnace from charging device 3 toward a discharge device 2 as the hearth 1 rotates, fuel and oxygen-contained gas are blown into the furnace from a plurality of burners 7*c* installed on the furnace body 7 at the upper part of the hearth, fuel, inflammable volatile components generated from powdery carbonaceous material, and CO gas generated as the result that powdery iron oxide is reduced, and the lump-like substance (raw material) placed on the hearth is radiation-heated from the top at in-pile atmosphere temperature of approximately 1200 to 1500° C.

As fuel for a burner, any of gas fuel such as natural gas, coke furnace gas, propane gas, butane gas or the like, liquid fuel such as heavy oil, or solid fuel such as coal waste plastic or a combustible will suffice, and as oxygen-contained gas, air or oxygen-enriched air is suggested to be used.

The lump-like substance (raw material) 9 placed on the hearth is heated to approximately 1200 to 1450° C. by radiation heating from the upper part of the hearth during in-pile movement, and powdery iron oxide in the lump-like substance is reduced by the powdery carbonaceous material and metallized.

On the other hand, a part of powder generated at the time of charging and at the time of heating the lump-like substance 9 or at the time of discharging reduced iron 10 is stayed for a period of time on the hearth, and progresses in sintering and reducing to form a stuck substance in which metal iron and ore texture (slag texture) are mixed.

The lump-like substance (reduced iron 10) metallized upon termination of reduction is cooled, in order to provide mechanical strength enough to endure against handling at the time of discharge and after discharge from the hearth of the rotary furnace which is a rotary hearth type reducing furnace, to approximately 1000° C. by a cooler 8 installed this side of the discharging device 2. As a cooling method, there may be employed a method of directly spraying inert gas such as $N_2$ or hydro-carbon such as natural gas on reduced iron, or a method for indirectly cooling by a water cooling jacket.

The reduced iron 10 cooled to approximately 1000° C. is discharged by the discharge device 2. As a discharge device, there can be employed a discharge device of a screw system of course, or a scraper system.

FIG. 1 is an explanatory view showing one embodiment of the present invention. This is characterized by the provision of directly quenching means (hereinafter referred to as "spraying means") for quenching the hearth surface over the widthwise of the hearth from the forward (toward the moving direction of the hearth) of the discharge device 2 of the reduced iron (product) 10 to the charge device 3 of the lump-like substance raw material) 9, and stuck substance scraping means for removing stuck substance from the further forward to the charge device 3.

When after operation is carried out for a fixed time, a thickness of the stuck substance 11 increases, removal of the stuck substance 11 is carried out by the following means. First, a considerable quantity of spraying is carried out on the surface of the stuck substance 11 stuck on the hearth surface by the spraying means 4. Thereby, the stuck substance 11 is quenched and contracted rapidly to generate crack 12 of a fixed depth on the surface of the stuck substance 11. Further, metal iron in the vicinity of the surface of the stuck substance 11 and in the vicinity internally of the crack 12 is oxidized by water to weaken its texture. A number of cracks 12 occur on the surface of the stuck substance 11 over the widthwise of the hearth as described above, and the texture itself of the stuck substance 11 becomes weakened. So, the surface of the stuck substance 11 weakened is scraped by the stuck substance scraping means 6 whereby the stuck substance 11 is easily stripped off from the cracks 12, which is divided into a number of narrow pieces peeled pieces 13) and removed from the hearth 1.

After removal of the peeled pieces 13, new lump-like substance (raw material 9) is placed by the charge device 3 at a position thereof on the hearth 1 from which the stuck substance 11 was removed, and is reduced when passing through the high temperature furnace to form reduced iron 10. Then, when the reduced iron 10 is discharged by the discharge device 2, the stuck substance 11 has been removed already, because of which the knife edge of the discharge device 2 does not progress in wear.

It is noted that by changing the quantity of spraying, it is possible to change the depth of the crack 12 to adjust the thickness of the peeled piece 13 to be removed, as shown in the Embodiment 1 described later. That is, when the spraying quantity is increased, the cooling speed of the surface of the stuck substance 11 rises to increase the contraction quantity, and the depth of the crack 12 also becomes large. Accordingly, in a case where the thickness of the stuck substance 11 is thin, the spraying quantity is reduced and shallow cracks are generated while preventing excessive cooling of the hearth 1 to scrape it thinly. In a case where the thickness of the stuck substance 11 is thick, the spraying quantity is increased, the cracks are deepened and the texture is sufficiently oxidized to weaken it, after which scraping may be applied thereto. Since not only the thickness of the stuck substance 11 but also properties such as minuteness or hardness differ depending upon raw material used or operating conditions (such as reducing temperature, operating time and so on), the spraying quantity cannot be decided generally, but when the present invention is applied, the spraying quantity may be suitably changed to observe the quantity and thickness of the narrow pieces (peeled pieces 13) of the stuck substance to be removed to thereby decide a proper spraying quantity. Further, also, by changing spraying circumstances such as grain size of water droplets sprayed, the range of the hearth to be cooled or cooling quantity can be adjusted, and therefore the thickness of the peeled pieces 13 removed can be adjusted.

Above, although the direct quenching means 4 was explained as a spray means, it is not restricted to this. As the direct quenching means, for enabling watering (or sprinkling or pouring or injecting) over the entire width of the hearth there can be used, for example, a plurality of pipes directed downward at fixed intervals from a ceiling part 7*a* immediately above the surface of the hearth 1 to be sprayed to the widthwise of the hearth, and water may be dropped from the extreme end of each pipe or be sprayed by air. It is noted as water to be sprayed, not only clean water but water for cooling the hearth can be used, which is not particularly restricted.

As the stuck substance scraping means 6, there can be employed a scraper machine of a screw system or a scraper system similiar to the discharger device 2. Also preferably, the knife edge of the scraping means is made to be sharp to smooth the hearth surface after the stuck substance has been scraped. Even if the knife edge is sharpened, the texture of the stuck substance became weakened due to spraying as mentioned above, and the knife edge of the scraping means 6 is less worn.

It is noted that the stuck substance scraping means 6 is not always necessary, but the discharge device 2 may be used instead. In this case, the stuck substance having the crack is moved around substantially once within the furnace and scraped by the discharge device 2. Even if the stuck substance is heated again when passing through the furnace, it is not sintered again because of a short period of time but scraped easily by the discharge device 2, and the knife edge of the discharge device 2 is not worn.

Spraying and scraping of the stuck substance may be carried out when reduced iron is produced, or may be carried out when reduced iron is not produced, the limp-like substance is not placed while holding the furnace at high temperature and only the hearth is rotated (idling). In a case where spraying and scraping of the stuck material are carried out during idling, the spraying means 4 may be provided at the rear of the discharge device 2 (toward the hearth rotating direction).

A further embodiment of the present invention is characterized by the provision of stuck substance breaking means 5 in place of the spraying means 4 (see FIG. 2). Mechanical shock is applied to the surface of the stuck substance 11 over the widthwise of the hearth by the stuck substance breaking means 5 to thereby enable generation of a number of cracks in a stuck substance 11, similar to that the surface of the stuck substance 11 is sprayed, and therefore, it can be scraped from the hearth 1 by the stuck substance scraping means 6 for removal. In the case of this method, since spraying is not carried out, the hearth is not cooled but heat transfer to the lump-like substance placed newly from the hearth surface at high temperature can be effectively utilized, thus providing the effect capable of maintaining productivity of reduced iron.

Also, in the present embodiment, likewise, the stuck substance scraping means is not always necessary, but the discharge device 2 can be utilized instead. Further, application of mechanical shock and scraping of stuck substance may be carried out when reduced iron is produced or during idling. In a case where application of mechanical shock and scraping of stuck substance are carried during idling, the stuck substance breaking means 5 may be provided at the rear (toward the hearth rotating direction) of the discharge device 2.

FIG. 3 is an explanatory view showing another embodiment of the present invention. This is characterized by the further provision of the stuck substance breaking means 5 between the spraying means 4 and the stuck substance scraping means 6 shown in FIG. 1.

As previously mentioned, the stuck substance 11 after spraying is weak, and has a number of cracks 12 on the surface thereof. Accordingly, mechanical shock is further applied to the stuck substance by the stuck substance breaking means 5 to enable enlargement of the cracks 12 or peeling off from the hearth surface to divide into narrow pieces (peeled pieces 13), and even if a load of the stuck substance scraping mean 6 is made small, they can be scraped easily. That is, the wear of the knife edge of the stuck substance scraping means 6 can be further relieved. Further, as compared with the method by way of only the stuck substance breaking means described above, the mechanical shock caused by the stuck substance breaking means 5 can be made smaller, and therefore, the wear of the extreme end of the stuck substance breaking means 5 and the damage of the hearth 1 are relieved.

As the stuck substance breaking means 5, for example, there can be used a rod of a cylinder 5*a* which is driven up and down mounted on a ceiling part 7*a* upward of the hearth 1 as shown in FIG. 3(*a*). Preferably, on the extreme end of the rod is mounted a sharp shaped tip as in the extreme end of a minus (–) screw driver as shown in FIGS. 3(*a*) and (*b*) so that the stuck substance 11 is easily broken. It is noted that even in a case where the wear of the tip progresses so that it need to be replaced, that can be done easily as compared with replacement of a screw of the discharge device 2 in prior art. Further, when a portion of the stuck substance breaking means 5 in direct contact with the hearth 1 (in case of the rod, the tip) is exposed to the atmosphere gas within the furnace except when the mechanical shock is applied, that portion assumes a high temperature, and therefore, it is desired that the portion be interrupted from the atmosphere gas or the water cooling jacket or the like is used to cool it. Thereby, the wear is relieved, and thermal shock is to be applied simultaneously with the mechanical shock to further increase the effect. Moreover, the rod is not only driven up and down by the cylinder, but the rod may be merely dropped from the ceiling 7 or driven up and down using a motor or a link mechanical.

The spraying means 4 and the stuck substance breaking means 5 may be installed in plural number at fixed intervals over the widthwise of the hearth, for example, as shown in FIG. 3(*b*). The installation spacing of the spraying means 4 and the spraying range per spraying means may be decided in consideration of occurrence of cracks in wider range than the spraying range, and may not be necessary that the spraying ranges are superposed so that water is applied directly to the whole hearth width, as shown in FIG. 3(*b*). While in FIG. 3(*b*), the spraying means 4 and the stuck material breaking means 5 are arranged by one row, it is noted that the arrangement is not always limited thereto, but both or one may be arranged in plural rows.

Another embodiment of the present invention shown in FIGS. 1 and 3 is characterized by the provision of hearth surface heating means for reheating the hearth surface between the spraying means 4 and the stuck substance scraping means 6 (not shown). In the case of FIG. 3, the hearth surface heating means may be installed either forward or backward of the stuck substance breaking means 5. The weakened stuck substance having cracks due to spraying (or spraying+breaking) is reheated whereby the surface of the stuck substance becomes softened, and so, it can be easily scraped by the stuck substance scraping means 6, and the wear of the knife edge of the stuck substance scraping means 6 is further relieved. Further, the hearth 1 once cooled by spraying is reheated whereby the heat transfer to raw material (lump-like substance 9) placed newly from the surface of the hearth 1 can be utilized to expect maintenance of productivity of reduced iron and an improvement in effect.

It is noted that in the case of FIG. 2 where spraying means is not used, it is possible to provide hearth surface heating means between the stuck substance breaking means 5 and the stuck substance scraping means 6, and the similar effect can be expected.

As the hearth surface heating means, for example, a linear burner inserted so as to cross the hearth width in a horizontal direction from the side wall of the furnace can be used. For example, the linear burner is a pipe-like combustion burner having downwardly directed burner holes at fixed intervals in a longitudinal direction, which may be installed upwardly of the hearth surface, and the whole width of the hearth may be heated substantially uniformly. When the combustion burner is used, preferably, effect is added such that metal iron in the stuck substance is oxidized by oxidative combustion exhaust gas to further weaken the stuck substance.

The spraying means 4, the stuck substance breaking means 5, and the stuck substance scraping means 6 may be installed at any position of the rotary hearth type reducing furnace as long as they are installed such that in a case where only 4 and 6 (or 5 and 6) are installed, they are installed in order of 4→6 (or 5→6) in a rotational definition of the hearth; and in a case where all 4 to 6 are installed, they are installed in order of 4→5→6 (or 5→4→6) in a rotational direction of the hearth. Particularly, in a case where the stuck substance is removed at the time of idling during which reduced iron is not produced, raw material and reduced iron are not present on the hearth, and therefore, spraying, application of mechanical shock, and removal of stuck substance may be carried out at any location within the furnace. Further, preferably, the above-described means 4 to 6 may be installed at location between the discharge device 2 and the charge device 3 (along the rotational direction of the hearth) which is a location in which raw material and reduced iron are not present even during production of reduced iron so that the stuck substance may be removed even during production of reduced iron.

The method of quenching is not limited to spraying, but there can be employed a method for spraying cooled inert gas or air on the hearth. Further, more preferably, one which generates inflammable gas by heat decomposition such as heavy oil or alcohol may be employed since reoxidization of reduced iron can be prevented.

While in the foregoing, production of reduced iron has been described as an example, it is noted that as raw material comprising powdery metal oxide and powdery carbonaceous material, there can be used powdery material in which powdery metal oxide and powdery carbonaceous material are mixed, or raw pellets in which powdery metal oxide and powdery carbonaceous material are mixed and granulated by a granulator, or dry pellets in which moisture of the raw pellets is removed by a dryer, and in addition, briquette-like, plate-like or block-like material obtained by mixing and pressing powdery metal oxide and powdery carbonaceous material can be also used.

In a case where powdery metal oxide and powdery carbonaceous material are mixed, after which they are molded into pellets or briquettes, binders such as bentonite, calcium hydroxide, or organic caking agents may be added. Metal to be produced include Ni, Cr and so on other than iron.

EXAMPLES

Circumstances of generation of cracks in stuck substances caused by spraying were confirmed by experiments. First, a pellet (lump-like substance) having components shown in Table 1 is used, and operation was carried out at an atmosphere temperature of approximately 1300° C. by a rotary hearth furnace, after which the rotary hearth furnace was placed in an idling state and a position of a screw of the discharge device was set to a level lower than that when reduced iron is produced, and the hearth was scraped forcibly to discharge the hearth plate whose thickness is about 30 mm. The hearth plate was cut down on the flat plate of about 100 mm square to serve as an exponential sample. This sample was inserted into the heating furnace adjusting an atmosphere temperature to 1200° C. and as held for 3 hours in he atmosphere of $N_2$, after which a predetermined quantity of water at a normal temperature was applied to the range of about 30 mm square in a central part of the sample for a predetermined period of time and dropped. After dropping water, the sample was gradually cooled till normal temperature assumes for observation.

The dropping conditions of water and the circumstances of the sample surface after water dropping were summarized in Table 2.

TABLE 1

| | Mass % | | | | | |
|---|---|---|---|---|---|---|
| | T. Fe | C | $SiO_2$ | $Al_2O_3$ | CaO | MgO |
| Pellet | 60 | 13.5 | 2.0 | 1.0 | 8.8 | 1.2 |

TABLE 2

| Exp. No. | 1 | 2 | 3 |
|---|---|---|---|
| Drop water | 1.5 ml | 15 ml | 30 ml |
| Drop time | 8 sec | 3 sec | 3 sec |
| Dimension of division area by crack | long.; about 10–20 mm<br>lat.; about 10–20 mm<br>depth; about 0.5 mm | long.; about 15–80 mm<br>lat.; about 15–30 mm<br>depth; about 2 mm | long.; about 30–35 mm<br>lat.; about 30–35 mm<br>depth; about 8 mm |
| Dimention of peeled piece | long.; about 5–10 mm<br>lat.; about 5–10 mm<br>depth; about 0.5 mm | long.; about 10–15 mm<br>lat.; about 10–15 mm<br>depth; about 2 mm | long.; about 10–20 mm<br>lat.; about 10–20 mm<br>depth; about 2 mm |

Note:
long. is longitudinal, lat. is lateral, and depth. is thickness.

In any experiments of experiments No. 1 to 3 shown in Table 2, it is observed that a number of cracks are generated in two directions (longitudinal and lateral directions) crossing at right angles on the surface of the sample after water has been dropped, and observed that out of these areas divided in these longitudinal and lateral directions (divided areas caused by cracks), a partial area has been already peeled from the sample surface. It was observed that as the dropping quantity of water increases, the depth of crack increases, and the width of the divided area (longitudinal× lateral) also increases, and the thickness and width (longitudinal×lateral) of the already peeled portion peeled piece) also increase as the dropping quantity of water increases. The generation of cracks extended not only to the range in which water was dropped directly but alto to the range about 3 to 10 times of an area in the water dropping range in the periphery thereof. The divided area of cracks could be scraped into a thin plate simply by a finger after the sample has been cooled.

It was accordingly confirmed that after cracks have been generated by spraying water on the surface of the stuck substance, they can be scraped to thereby remove the stuck substance easily. Further, it was confirmed that the spraying quantity is changed to thereby enable adjustment of thickness of the stuck substance that can be removed. Furthermore, it was understood that since cracks are propagated to the wide range beyond the range sprayed directly, spraying not always need be done uniformly, and even by spraying at suitable intervals, cracks can be generated over the whole hearth width.

According to the present invention, after the hearth surfaced is quenched to generate cracks on the stuck substance stuck on the hearth, the stuck substance is removed from the hearth whereby the wear of the knife edge of the screw of the discharge device can be prevented or reduced, the availability factor of the furnace is improved, the continuous operation for a long period of time is enabled, and the maintenance costs can be reduced.

According to the present invention, the mechanical shock is applied to the hearth surface to generate cracks on the stuck substance stuck on the hearth, and the stuck substance is removed from the hearth whereby the effect similar to that of the former invention can be obtained, and in addition, in a case where cooling of the hearth is not accomplished since quenching is not done, and the removal of the stuck substance is carried out when reduced metal is produced, the productivity of reduced metal can be maintained According to the present invention, the hearth surface is quenched to generate crack on the stuck substance stuck on the hearth, and the mechanical shock is applied to the hearth surface, after which the stuck substance is removed from the hearth whereby the stuck substance can be removed more easily and positively while relieving the wear of the extreme end of the stuck substance breaking means and the knife edge of the stuck substance scraping means.

According to the present invention, since the quenching method is applied to direct spraying to the hearth surface, the above-described effect can be obtained at low cost by simple equipment.

According to the present invention, since the spraying quantity is changed whereby the thickness of the stuck substance removed can be adjusted, the above-described effect can be obtained positively by the minimum spraying as necessary.

According to the present invention, as means for applying the mechanical shock, a method for dropping the stuck substance breaking means installed on the ceiling upward of the hearth surface, or a method for driving the stuck substance breaking means up and down is used, whereby the maintenance is greatly facilitated, the availability factor is improved, and the maintenance costs can be considerably saved.

According to the present invention, after the quenching or after application of the mechanical shock and before removal from the hearth, the hearth surface is reheated whereby the stuck substance can be removed easily, and in addition, in a case where the removal of the stuck substance is carried out when reduced metal is produced, the productivity of reduced metal can be maintained and improved.

According to the present invention, the hearth surface is a hearth surface from the position at which reduced metal is discharged to the position at which the raw material is charged toward the rotating direction of the hearth whereby the stuck substance can be removed during the production of reduced iron thus enabling further improvement in availability factor.

We claim:

1. An operating method of a rotary hearth type reducing furnace for producing reduced metal from raw material comprising at least metal oxide and carbonaceous material, the method including the sequential steps of:

discharging a reduced metal;

quenching a hearth surface of said rotary hearth type reducing furnace sufficiently to form a crack in a substance stuck to said hearth surface, and removing the stuck substance from said hearth.

2. The operating method of a rotary hearth type reducing furnace according to claim 1, wherein said quenching is directly quenching with water.

3. The operating method of a rotary hearth type reducing furnace according to claim 2, wherein a quantity of said water is changed to thereby adjust a thickness of the stuck substance removed.

4. The operating method of a rotary hearth type reducing furnace according to claim 1, wherein after said quenching and before removal of said stuck substance from said hearth, said hearth surface is reheated.

5. An operating method of a rotary hearth type reducing furnace for producing reduced metal from raw material comprising at least metal oxide and carbonaceous material, the method including the sequential steps of:

discharging a reduced metal;

applying mechanical shock to a hearth surface, and removing the stuck substance from said hearth.

6. The operating method of a rotary hearth type reducing furnace according to claim 5, wherein stuck substance breaking means installed on a ceiling upward of said hearth surface is dropped on said hearth surface to thereby apply mechanical shock.

7. The operating method of a rotary hearth type reducing furnace according to claim 5, wherein stuck substance breaking means installed on a ceiling upward of said hearth surface is driven up and down to thereby apply mechanical shock.

8. The operating method of a rotary hearth type reducing furnace according to claim 5, wherein after application of said mechanical shock and before removal of said stuck substance from said hearth, said hearth surface is reheated.

9. An operating method of a rotary hearth type reducing furnace for heating and reducing raw material comprising at least metal oxide and carbonaceous material to produce reduced metal, the method including the steps of:

discharging a reduced metal;

quenching a hearth surface of said rotary hearth type reducing furnace from which the reduced material has been removed, sufficiently to form a crack in a substance stuck to said hearth surface, applying mechanical shock to the hearth surface from which the reduced material has been removed, and removing the stuck substance from said hearth.

10. The operating method of a rotary hearth type reducing furnace according to claim 9, wherein said quenching is directly quenching with water.

11. The operating method of a rotary hearth type reducing furnace according to claim 10, wherein a quantity of said water is changed to thereby adjust a thickness of the stuck substance removed.

12. The operating method of a rotary hearth type reducing furnace according to claim 9, wherein stuck substance breaking means installed on a ceiling upward of said hearth surface is dropped on said hearth surface to thereby apply mechanical shock.

13. The operating method of a rotary hearth type reducing furnace according to claim 9, wherein stuck substance breaking means installed on a ceiling upward of said hearth surface is driven up and down to thereby apply mechanical shock.

14. The operating method of a rotary hearth type reducing furnace according to claim 9, wherein after said quenching or after application of said mechanical shock and before removal of said stuck substance from said hearth, said hearth surface is reheated.

15. An operating method of a rotary hearth type reducing furnace for heating and reducing raw material comprising at least powdery metal oxide and powdery carbonaceous material to produce reduced metal, wherein a hearth surface of said rotary hearth type reduced furnace, from which the reduced metal has been removed, is quenched to generate a crack in a stuck substance stuck on said hearth, after which said stuck substance is removed from said hearth.

16. An operation method of a rotary hearth type reducing furnace for heating and reducing raw material comprising at least powdery metal oxide and powdery carbonaceous material to produce reduced metal, wherein mechanical shock is applied to a hearth surface of said rotary hearth type reducing furnace, from which the reduced metal has been removed, to generate a crack in a stuck substance stuck on said hearth, after which said stuck substance is removed from said hearth.

17. An operating method of a rotary hearth type reducing furnace for heating and reducing raw material comprising at least powdery metal oxide and powdery carbonaceous material to produce reduced metal, wherein a hearth surface of said rotary hearth type reducing furnace, from which the reduced metal has been removed, is quenched to generate a crack in a stuck substance stuck on said hearth, and mechanical shock is applied to said hearth surface, from which the reduced metal has been removed, after which said stuck substance is removed from said hearth.

* * * * *